United States Patent [19]

Scott

[11] Patent Number: 4,653,653

[45] Date of Patent: Mar. 31, 1987

[54] HOISTING SYSTEMS

[75] Inventor: Edward S. Scott, Alliance, Ohio

[73] Assignee: The Alliance Machine Company, Alliance, Ohio

[21] Appl. No.: 770,291

[22] Filed: Aug. 27, 1985

[51] Int. Cl.[4] ..... B66C 13/18; B66C 13/16

[52] U.S. Cl. ..... 212/149; 212/153; 212/159; 212/174; 212/205

[58] Field of Search ..... 212/146, 153, 159, 174, 212/205

[56] References Cited

U.S. PATENT DOCUMENTS

| | | | |
|---|---|---|---|
| 3,786,935 | 1/1974 | Vlazny et al. | 212/146 |
| 3,973,679 | 8/1976 | Hass et al. | 212/205 |
| 4,069,921 | 1/1978 | Raugulis et al. | 212/205 |
| 4,597,497 | 7/1986 | Aberegg | 212/149 |

FOREIGN PATENT DOCUMENTS

| | | | |
|---|---|---|---|
| 2015461 | 3/1978 | United Kingdom | 1/58 |
| 582176 | 11/1977 | U.S.S.R. | 212/147 |

OTHER PUBLICATIONS

"Improved Safety for Overhead Cranes, E. J. Hall, *OEM Design*, Aug. 1983.

*Primary Examiner*—Trygve M. Blix
*Assistant Examiner*—R. B. Johnson
*Attorney, Agent, or Firm*—Buell, Ziesenheim, Beck & Alstadt

[57] ABSTRACT

A safety system for overhead hoisting cranes is provided which incorporates a overload release coupling in the high speed drive shaft between the prime mover and the gear reducers driving one or more hoist drums with a dual reeving and a safety brake acting on the high speed drive shaft at the gear reducers and controlled by an overrunning clutch and a control means.

6 Claims, 7 Drawing Figures

HOISTING SYSTEMS

This invention relates to hoisting systems and particularly to safety hoist systems, designed to prevent the loss of a load to any single point failure excepting a failure of the lower sheave block.

Overhead cranes are used in a very large number of industries and in thousands of plants throughout the world. Such cranes, because they lift and traverse heavy loads above shop work areas, are inherently a source of possible serious physical damage to equipment and personnel in the event of failure of a component in the lift system. As a result of this known potential for damage, overhead cranes have historically been carefully designed and manufactured and are usually conservatively over designed for the intended loadings. Nevertheless, such cranes are sometimes abused by operators, neglected by maintenance people or are the subject of errors in maintenance and replacement and sometimes, as a result, lose a load. This is not acceptable in most cases.

In some critical applications, such overhead cranes have been designed with dual reeving systems in an effort to solve this problem. Here again, however, if the system is not properly maintained or is frequently abused, one or both of the parts of the dual recovery system can be so damaged over time that they will fail.

Failures of overhead cranes are most frequently prompted by causing the lower block to strike the crane frame and thus overstressing or even cutting the lift cables (generally called two blocking in the industry) or by load hangup on some extraneous object (generally called snag loading) which in effect produces the same result as two blocking. Both situations are aggrevated by the inability to remove power from or otherwise stop the hoist motor quickly enough to prevent damage when two blocking or snag loading occurs.

I have invented a hoisting system designed to overcome these problems by incorporating overload release couplings between the drive motor and gear reducers, by using safety brakes with overrunning clutches which allow rotation of the hoisting drum only while hoisting with the brakes set and by a shock absorber system at the upper sheaves.

I provide a safety system for an overhead crane comprising a hoist frame, at least one hoist drum on said frame, at least one gear reducer drivingly engaging said drum, a prime mover on said frame, a drive connection between said prime mover and gear reducer for driving said gear reducer, an overload release coupling means in said drive connection disconnecting said coupling in the event of an overload on the hoist drum, a lower sheave block beneath the frame, dual receiving means connecting said sheave block to said at least one hoist drum, shock absorbing means on said frame engageable by said upper sheave block in the event said lower sheave block is brought into contact with said frame, an overrunning clutch on said drive connection between the overload release coupling means and the gear reducer, safety brake means on said drive means adjacent the overrunning clutch and operatively connected thereto whereby to brake the drive connection against rotation in the non-hoisting direction and to release the drive connection for hoisting and control means acting on said overriding clutch and brake means to hold the brakes in released position during normal lowering and in operative position during hoisting. Preferably I provide a pair of hoist drums, gear reducers, safety brake, overrunning clutches and overload releasing couplings driven by a common prime mover with each hoist drum operatively connected to one of the dual reeving means. Alternatively, I may provide a single hoist drum with a gear reducer at each end, one acting as the operative drive and the other acting as a support in case of failure in said one reducer. In this alternative system each gear reducer is connected to a common prime mover through a drive connection incorporating an overload release coupling, an overruning clutch and safety brake means.

In the foregoing general description of my invention I have set out certain objects, purposes and advantages of my invention. Other objects, purposes and advantages will be apparent from a consideration of the following description and the accompanying drawings in which.

Figure 7:
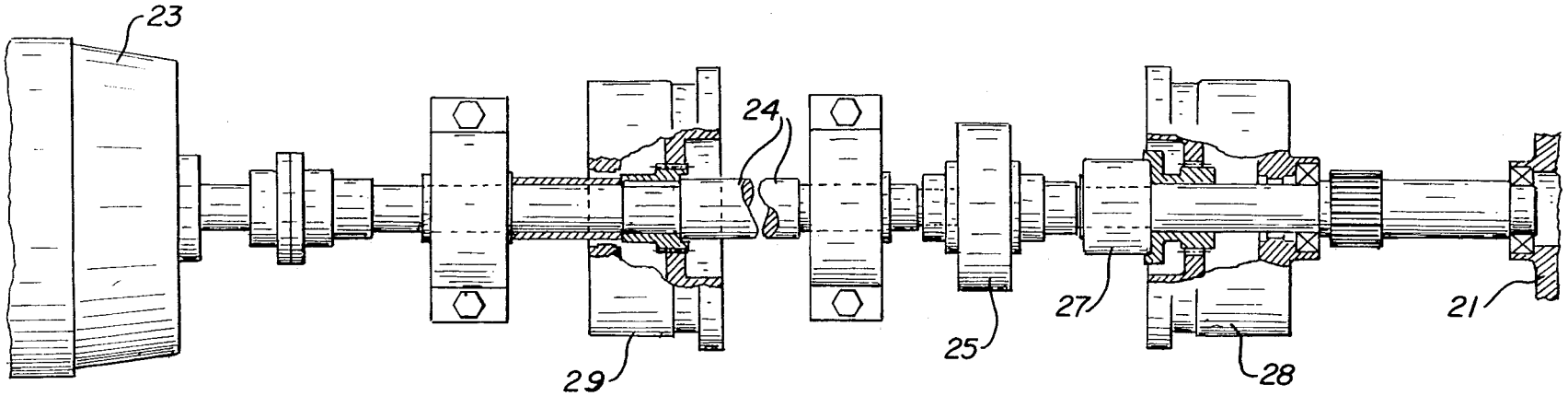

FIG. 7 is a fragmentary enlarged view, partly in section of the prime mover and drive connections to the gear reducers; and Referring to the drawings, I have illustrated a conventional overhead crane frame 10 having drive wheels 11 driven by motor 12 and running on rails 13 on a traversing crane beam 14 in usual fashion. A pair of hoist drums 15 and 16 are mounted on frame 10 on a common axis line for rotation in bearings 17 and 18 and 19 and 20. Drum 15 is operatively connected to a gear reducer 21 and drum 16 is operatively connected to a like gear reducer 22. Each of the gear reducers 21 and 22 is connected to a prime mover 23 by means of a main drive shaft 24 through an overload release coupling 25, such as a Zurn Torc or some other type of overload release or slip clutch and a secondary drive shaft 26. The secondary drive shaft 26, which extends from the overload release coupling 25 carries an overrunning clutch 27, such as for example, a Dana Industrial "Formsprag" overrunning clutch, operatively connected to a brake means 28, such as a Stromag Inc. electromagnetic spring applied thereto, on the frame so that when the hoist is lifting, the brake is set and so that if hoisting stops and an unintended lowering starts the safety brakes will be set and the overrunning clutch will prevent lowering. A control means, not shown, releases the safety brakes when normal lowering occurs, however, when the crane is in hoisting mode the safety brakes are set and motion permitted by the overriding clutch during hoisting and a reversal of rotation of shaft 26 causes the clutches automatically to engage. Normal braking action is accomplished by standard operating brake 29.

In operation the hoist drums 15 and 16 are driven by prime mover 23 through gear reducers 21 and 22, shaft 24, shaft 26 and overload release coupling 25 which is set to release at a predetermined overload. If the load block 30 which is suspended on double cables 31 and 32 from drums 15 and 16 is two blocked or has a load hang-up, creating an overload, the release coupling 25 will release the prime mover from secondary drive shaft 26 whereupon the brake means 28 will be set and the clutches will automatically engage holding the load block 30 and the load thereon in position until the problem is cleared.

Figure 1:
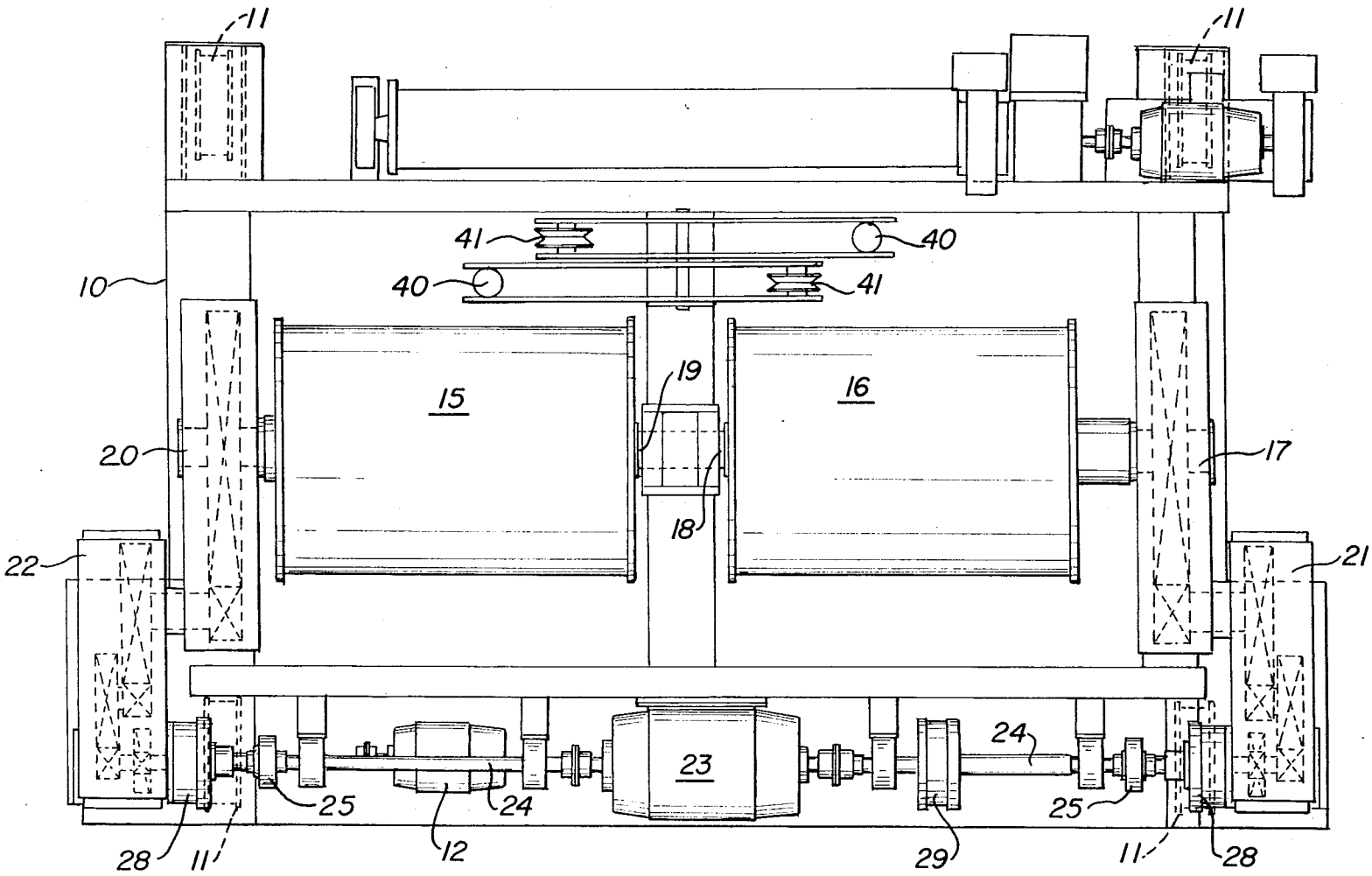
FIG. 1 is a top plan view of a preferred embodiment of this invention.
Figure 2:
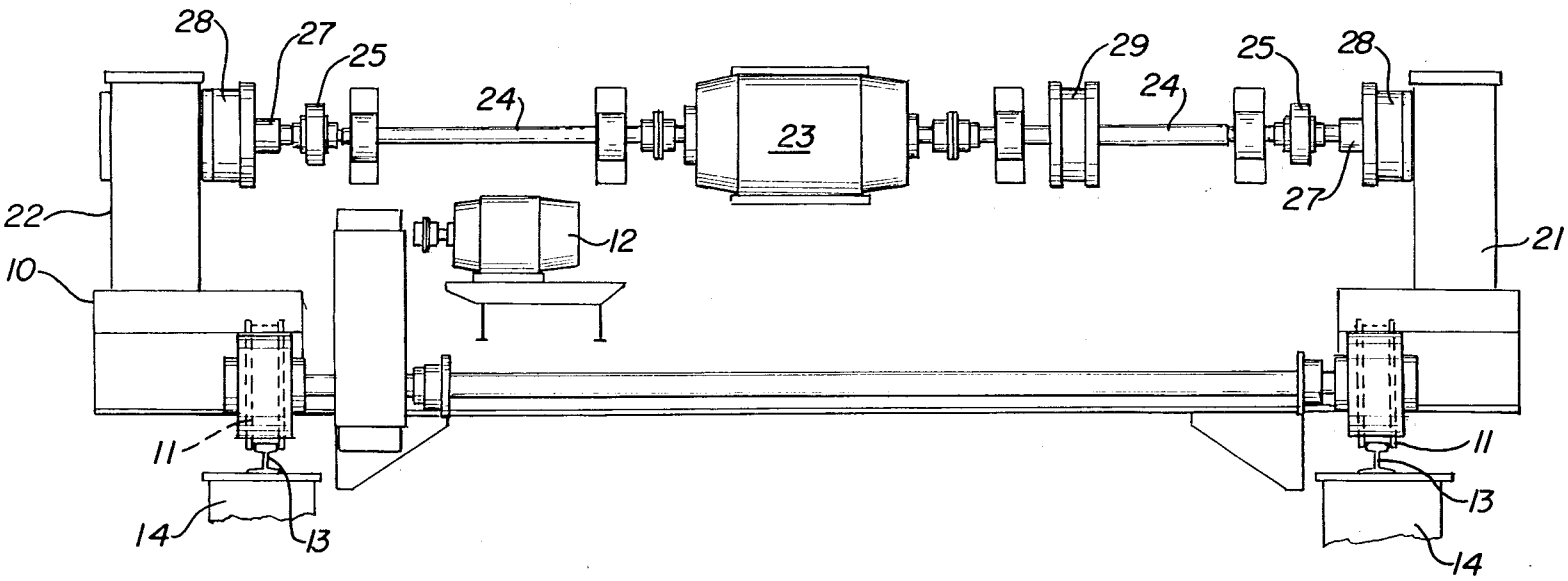
FIG. 2 is an end elevational view of the embodiment of FIG. 1.
Figure 3:
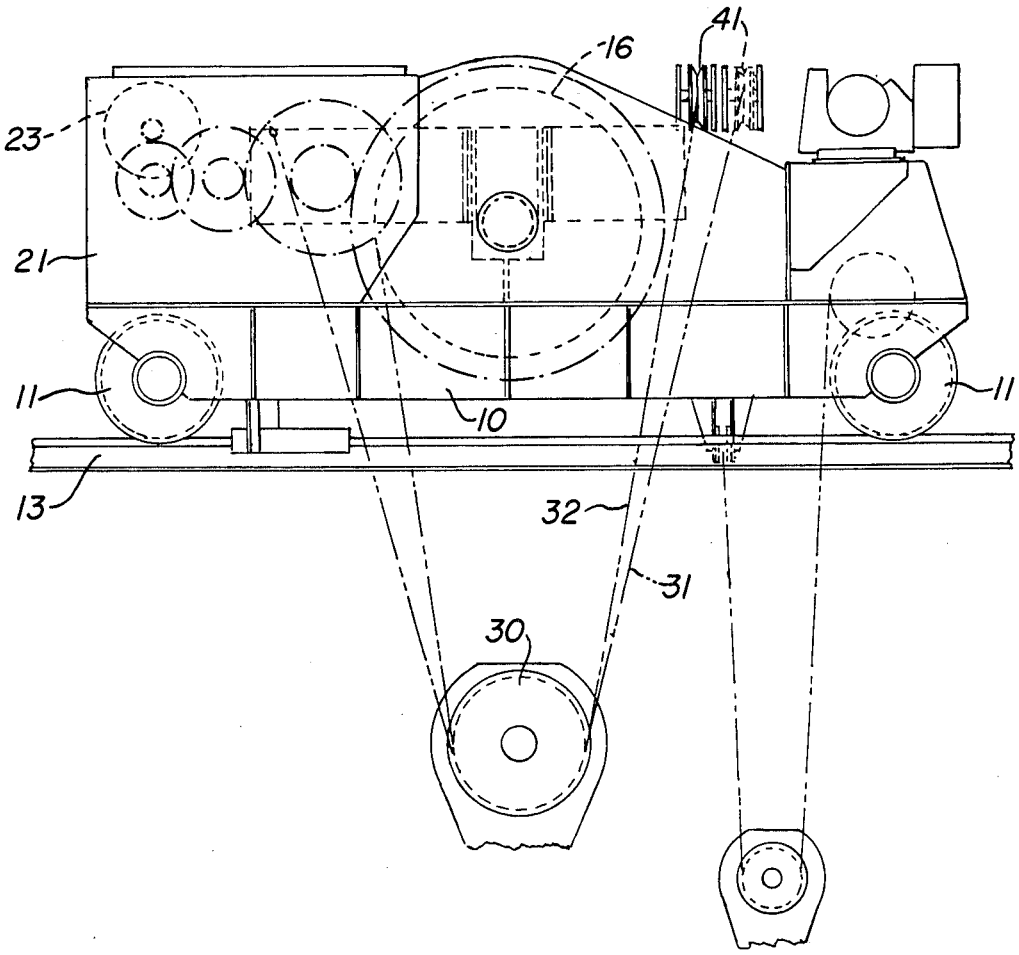
FIG. 3 is a side elevational view of the embodiment of FIG. 1.
Figure 4:
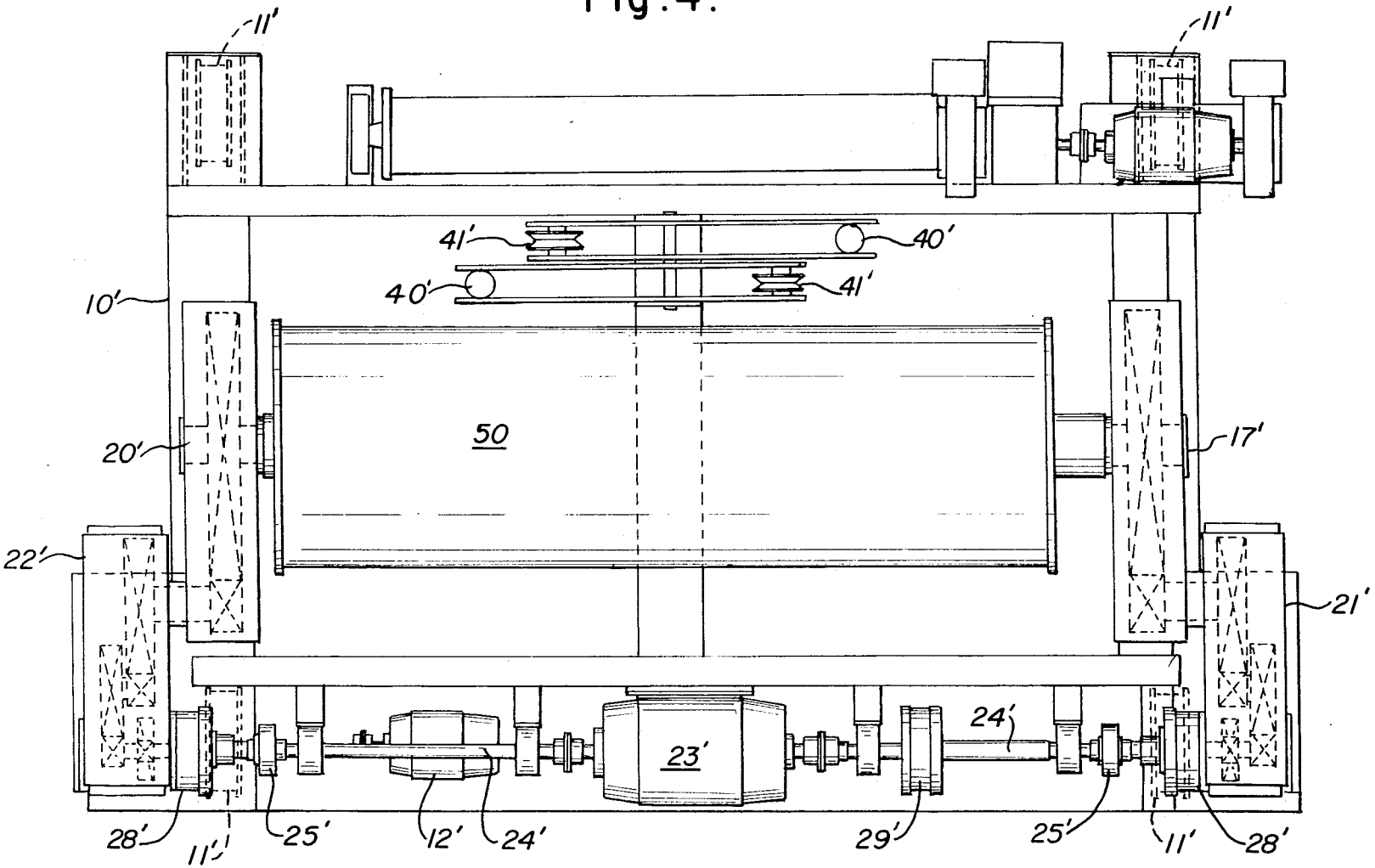
FIG. 4 is a top plan view of a second embodiment of this invention.
Figure 5:
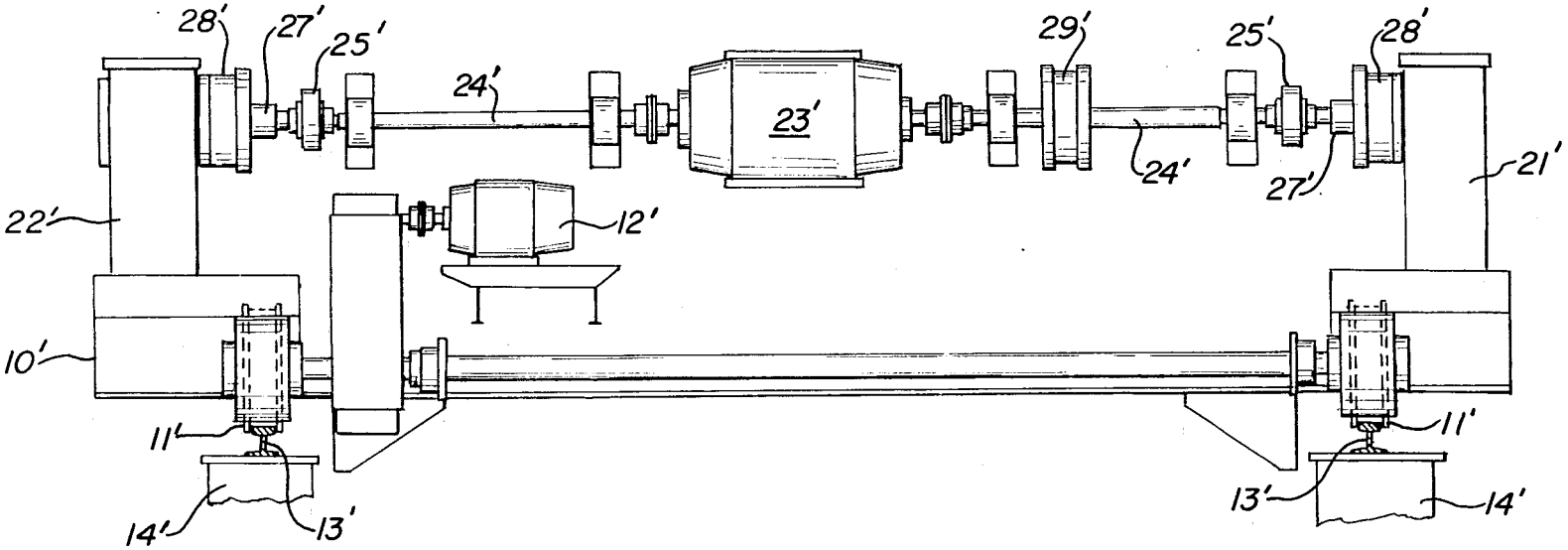
FIG. 5 is an end elevational view of the embodiment of FIG. 4.
Figure 6:
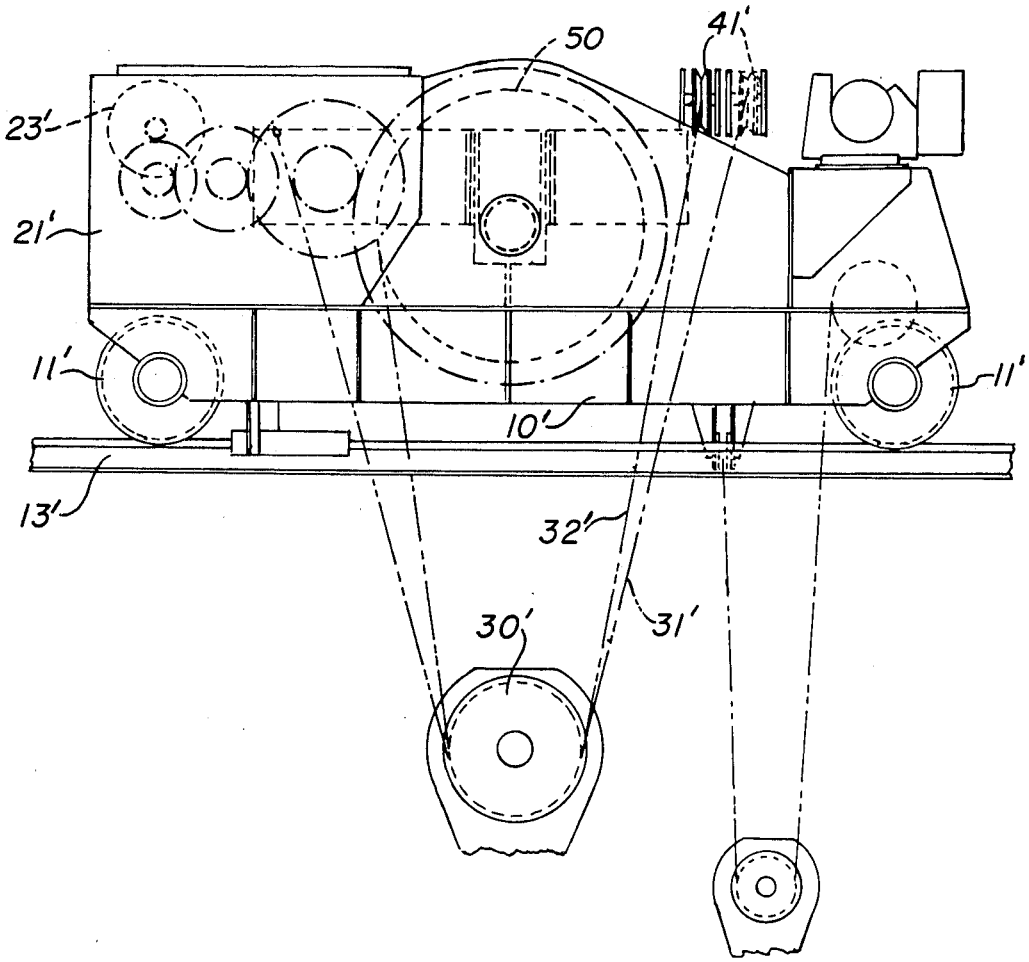
FIG. 6 is a side elevational view of the embodiment of FIG. 4.

In the second embodiment illustrated in FIG. 4, I provide a single hoist drum 50 with dual cables 31' and 32' on frame 10'. In this embodiment like parts to those of FIGS. 1 through 3 will have like numbers with a prime sign. The drum 50 is driven by a prime mover 23' through shaft 24', overload release coupling 25', secondary shaft 26' and gear reducer 21'. A second drive shaft 24', overload coupling 25', secondary shaft 26' and gear reducer 22' is connected between prime mover 23' and the other end of hoist drum 50. This second drive train is sized to support the load if the primary train fails but is otherwise a redundant system which is not loaded. The secondary shafts 26' of each drive train are provided with overrunning clutches 27' and safety brake means 28' precisely as in FIGS. 1 through 3. The operation of the system on a two blockage or a load hang-up is precisely as in FIGS. 1 through 3.

The braking action in the system of this invention, both normal and emergency, is applied at the high speed drive shaft and not at the output (e.g. the hoist drums) thus eliminating any damaging inertial loads at the reducer. The system of this invention does not require any expendable components, such as a crushable structure or the like, thus the hoist can be quickly placed back in operation following an abnormal loading. There are no limit switches or electronic sensing devices or other extraneous devices used for any of the major safety features, but, on the contrary, the safety system is an intergral part of the hoist system itself. There is, therefore, no secondary system to maintain or adjust.

In order to reduce the abruptness of overload on the occurrence of a two block or load hangup, I provide a shock absorber 40 on the frame 10, supporting the upper sheaves 41, which absorbs a part of the shock by allowing movement of the upper sheaves.

In the foregoing specification, I have set out certain preferred practices and embodiments of this invention, however, it will be understood that the invention may be otherwise embodied within the scope of the following claims.

I claim:

1. A safety system for an overhead hoisting crane comprising a hoist frame, at least one hoist drum on said frame, at least one gear reducer drivingly engaging said drum, a prime mover on said frame, a drive connection between said prime mover and the gear reducer drivingly connecting the two, an overload release coupling in said drive connection disconnecting the prime mover and gear reducer in the event of a predetermined overload in the hoist drum, a lower sheave block beneath the frame, dual reeving means connecting said sheave block to said at least one hoist drum, shock absorbing means on said frame engageable by said upper sheave block in the event the lower sheave block is brought into contact with said frame or in event of a load hangup, an overrunning clutch on said drive connection between the overload release coupling and gear reducer, safety brake means on said drive means adjacent the overrunning clutch and operatively connected thereto whereby to brake the drive connection against rotation in the non-hoist direction and to release the drive connection for hoisting and control means acting on said overrunning clutch and brake means to hold the safety brakes in released position during normal lowering of the lower sheave and in operative position during hoisting.

2. A safety system for an overload hoisting crane as claimed in claim 1 having a pair of hoist drums on a common axis, each carrying one of a dual reeving means, each driven from said prime mover through said drive connection including an overload release coupling, an overrunning clutch and safety brake and gear reducer.

3. A safety system for an overhead hoisting crane as claimed in claim 1 having a single hoisting drum with dual receiving means, a gear reducer drivingly connected to each end of said drum, a prime mover drivingly connected to each gear reducer through said drive connection including an overload release coupling, an overrunning clutch and safety brake and gear reducer.

4. A safety system as claimed in claim 1 or 2 or 3 wherein the overload release coupling is a torque overload release clutch.

5. A safety system as claimed in claim 4 wherein the overload release coupling is a slip clutch.

6. A safety system as claimed in claim 4 wherein the overload release coupling is a torque release clutch.

* * * * *